US007565844B2

(12) United States Patent
Crass et al.

(10) Patent No.: US 7,565,844 B2
(45) Date of Patent: Jul. 28, 2009

(54) TORQUE-ANGLE INSTRUMENT

(75) Inventors: Matthew M. Crass, Pleasant Prairie, WI (US); Thomas P. Becker, Kenosha, WI (US); Matthew S. Marquette, Omaha, NE (US); Richard J. Hackl, Milwaukee, WI (US); Paul J. Beyerl, Waterford, WI (US); Marvin D. Thorell, Racine, WI (US)

(73) Assignee: Snap-on Incorporated, Kenosha, WI (US)

( * ) Notice: Subject to any disclaimer, the term of this patent is extended or adjusted under 35 U.S.C. 154(b) by 36 days.

(21) Appl. No.: 11/603,540

(22) Filed: Nov. 22, 2006

(65) Prior Publication Data

US 2007/0144270 A1 Jun. 28, 2007

Related U.S. Application Data

(60) Provisional application No. 60/740,085, filed on Nov. 28, 2005.

(51) Int. Cl.
*B25B 23/14* (2006.01)

(52) U.S. Cl. ..... 73/862.21

(58) Field of Classification Search .. 73/862.21–862.23
See application file for complete search history.

(56) References Cited

U.S. PATENT DOCUMENTS

| | | | | |
|---|---|---|---|---|
| 4,091,664 | A | 5/1978 | Zerver | |
| 4,262,528 | A | 4/1981 | Holting | |
| 5,476,014 | A * | 12/1995 | Lampe et al. | 73/862.23 |
| 5,581,042 | A | 12/1996 | Tambini | |
| 5,589,644 | A * | 12/1996 | Becker et al. | 73/862.23 |
| 6,167,788 | B1 | 1/2001 | Schonberger | |
| 6,629,055 | B2 | 9/2003 | McGee et al. | |
| 6,698,298 | B2 * | 3/2004 | Tsuji et al. | 73/862.21 |
| 6,954,682 | B2 | 10/2005 | Makimae et al. | |
| 6,965,835 | B2 | 11/2005 | McGee et al. | |
| 6,968,759 | B2 * | 11/2005 | Becker et al. | 81/479 |
| 6,981,436 | B2 * | 1/2006 | Becker et al. | 81/479 |
| 2002/0152820 | A1 | 10/2002 | Tsuji | |
| 2003/0065456 | A1 | 4/2003 | McGee | |
| 2004/0187652 | A1 | 9/2004 | Pyre | |
| 2005/0092143 | A1 | 5/2005 | Lehnert et al. | |
| 2005/0109519 | A1 | 5/2005 | Kawai et al. | |
| 2005/0223856 | A1 | 10/2005 | Reynertson et al. | |
| 2005/0263304 | A1 | 12/2005 | Sainomoto et al. | |

FOREIGN PATENT DOCUMENTS

| | | |
|---|---|---|
| DE | 3832080 | 4/1989 |

(Continued)

*Primary Examiner*—Lisa M Caputo
*Assistant Examiner*—Freddie Kirkland, III
(74) *Attorney, Agent, or Firm*—Seyfarth Shaw LLP

(57) ABSTRACT

An electronic torque-angle instrument including a generally tubular body having a gripping section and a pivoting head for engaging a workpiece, such as a nut or bolt, and a housing associated with the body and containing electronics, including a microprocessor, which permit individual or simultaneous measurement of torque and angle applied to the workpiece. The microprocessor includes stored programs which interpret a signal from an input, such as a gyroscopic sensor, and sends the interpreted signal to an output means. The signal is finally displayed as an accurate torque measure and/or angle measure from the output means.

15 Claims, 22 Drawing Sheets

FOREIGN PATENT DOCUMENTS

| | | |
|---|---|---|
| DE | 20315000 | 12/2003 |
| DE | 10340710 | 3/2005 |
| EP | 1022097 | 7/2000 |
| GB | 2273574 | 6/1994 |
| WO | WO96/16761 | 6/1996 |

* cited by examiner

LEGEND
TU=TORQUE UNITS
AU=ANGLE UNITS
NTA=NO TORQUE APPLIED
(TORQUE<50% minTRACKVAL)
TAPP=TORQUE APPLIED
(TORQUE>minTRACKVAL)

LEGEND
TU=TORQUE UNITS
AU=ANGLE UNITS
NTA=NO TORQUE APPLIED
(TORQUE<50% minTRACKVAL)
TAPP=TORQUE APPLIED
(TORQUE>minTRACKVAL)

LEGEND
TU=TORQUE UNITS
AU=ANGLE UNITS
NTA=NO TORQUE APPLIED
(TORQUE<50% minTRACKVAL)
TAPP=TORQUE APPLIED
(TORQUE>minTRACKVAL)

LEGEND
TU=TORQUE UNITS
AU=ANGLE UNITS
NTA=NO TORQUE APPLIED
(TORQUE<50% minTRACKVAL)
TAPP=TORQUE APPLIED
(TORQUE>minTRACKVAL)

TORQUE-ANGLE INSTRUMENT

RELATED APPLICATION

This application is related to and claims the filing priority of U.S. Provisional Application No. 60/740,085, filed on Nov. 28, 2005 and entitled "Torque-Angle Instrument". The '085 application is hereby incorporated by reference.

BACKGROUND OF THE INVENTION

1. Field of the Invention

This application relates to wrenching tools and, specifically, to torque-angle measuring and recording wrenches.

2. Description of the Prior Art

The object of a wrenching tool is to rotate or hold against rotation an item, such as a threaded fastener (e.g. a bolt) joining two objects together. As the fastener is tightened it is stretched until it exerts the appropriate amount of compression force (called "bolt load") to the objects being held together or in place by the bolt. There is a relationship between the amount of torque that is applied to the head of a fastener and the amount of load applied to the joined objects. However, torque measurement is a poor method of determining 'bolt load,' because variations in frictional components vary the 'bolt load' achieved for a given torque applied.

Torque is considerably influenced by friction forces, the condition of the head, the amount, if any, of lubrication, as well as by other factors. The reliability of a torque measurement as an indication of desired load is, therefore, significantly variable. The solution is to rotate the bolt a specified number of degrees. This removes the friction-based error factor. Accordingly, a torque-angle fastener installation process, rather than torque measurement alone, is recommended in situations where tightening to recommended specifications is critical.

In a torque-angle fastener installation, a fastener is first tightened to a desired torque using a torque wrench; then the fastener is rotated through a predetermined additional angle of rotation. Because angle-based torquing is a more accurate way to ensure even tightening, more and more manufacturers are using the torque-angle procedure for tightening fasteners.

Another advantage of torque-angle installation is that like fasteners exert the same clamp forces without deviation from one fastener to the next due to variable conditions of lubrication, surface finish and the like previously mentioned.

At present, there are various wrenching tools available which meter angular rotation. Early angle measurement wrenching tools relied on some type of mechanical reference, usually a flexible strap connected to a "ground" clamp, for measurement of the angular rotation of a fastener.

More modern tools now use gyroscopes to meter angular rotation. One such device is disclosed in U.S. Pat. No. 4,262,528 to Holting et al. A gyroscope operates by offering opposition to a swiveling motion around an axis located transversely to its axis of rotation. Other torque-angle measuring tools on the market include KD Tools #3336 Torque Angle Gauge, Lisle Corp. #28100 Torque Angle Meter, SPX Corp. #4554 Stinger Torque Angle Gauge, Fel-Pro TRQ-1 Torque-to-Angle Indicator, and Kent-Moore J36660A Torque/Angle Meter. The disadvantages of these devices is that they require mechanical reference to a stationary point. This requires repositioning the reference arm for every fastener to be tightened, and a poorly positioned arm could cause gross errors in measurement, perhaps leading to component failure.

Still other similar devices come at a very high price (>US$1,200) and include complex menu-driven operation, which in some markets, such as automotive, may be prohibitive.

The present instrument in its various embodiments provides a solution to these and other problems in the relevant field.

SUMMARY OF THE INVENTION

There is disclosed herein a torque-angle instrument, such as a wrench, including a method of operation, for measuring applied torque and applied angle to a work-piece which avoids the disadvantages of prior devices while affording additional structural and operating advantages.

In a first embodiment of the disclosed method, the invention includes the steps of providing a wrench having a gripping section, a drive head, and internal circuitry coupled to the drive head, wherein the circuitry comprises a microprocessor having stored programming, input means, output means, and a power supply for powering the microprocessor, the input means and the output means, and then engaging the drive head of the wrench to a workpiece. The method then further comprise the steps of applying torque to the workpiece around the drive head, operating the input means to create a first signal related to the torque and angle being applied to the workpiece, receiving the first signal into the microprocessor from the input means, interpreting the signal by the stored programming, sending the interpreted signal to the output means, and then displaying the interpreted signal as an accurate torque measure and/or angle measure from the output means.

It is an aspect of the invention to include circuitry input means which comprise a gyroscopic sensor for measuring the rate of rotation around the drive head.

In an embodiment of the electronic torque-angle instrument, the device comprises a generally tubular body including a gripping section and a pivoting head for engaging a workpiece, such as a nut or bolt, and a housing associated with the body and containing electronics, including a microprocessor, which permit individual or simultaneous measurement of torque and angle applied to the workpiece.

It is an aspect of the electronic torque-angle instrument to include a microprocessor having stored programs for controlling the operation of the device. The device also includes input means, such as a gyroscopic sensor for measuring a rate of rotation around the pivoting head.

It is another aspect of the torque-angle instrument to include stored programs providing at least one of the features selected from the group consisting of bending beam deflection compensation; simultaneous torque and angle measurement; preset scroll stop at full-scale torque only; scroll through (past) angle mode without waiting for sensor initialization; angle mode torque units from last changed units; ignoring angle measure in reverse direction; sensor output offset monitoring; alternating display of peak torque and angle values; use of pre-torque direction to select allowable angle sensing direction; use of integer math to yield accuracy comparable to floating-point math; motion indicator at angle sensor initialization; temperature drift compensation; direct connection of the torque and angle sensors to the microprocessors; angle zero set function; signal level monitoring for over-speed indication; and sample data interrupt technique used to convert instantaneous angular velocity signal to filtered angle position.

These and other aspects of the invention may be understood more readily from the following description and the appended drawings.

BRIEF DESCRIPTION OF THE DRAWINGS

For the purpose of facilitating an understanding of the subject matter sought to be protected, there is illustrated in the accompanying drawings and flowcharts an embodiment thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1:
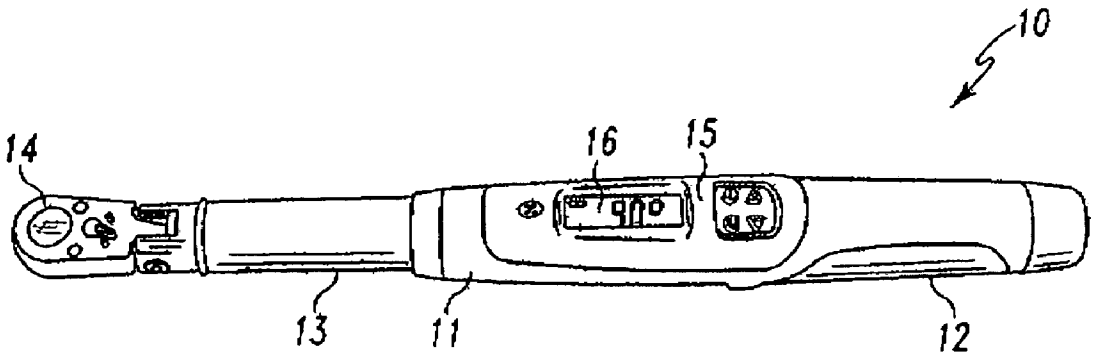
FIG. 1 is a side view illustrating one possible embodiment for the instrument of the present invention.

While this invention is susceptible of embodiments in many different forms, there is shown in the drawings and will herein be described in sufficient detail a preferred embodiment of the invention with the understanding that the present disclosure is to be considered as an exemplification of the principles of the invention and is not intended to limit the broad aspect of the invention to the embodiment illustrated.

The present application discloses a wrench that measures both torque and angle of rotation. It allows the tool user to perform bolt-tightening jobs requiring angle specifications with a single tool. A vibrating handle and audible tone alert the user when the measured torque or angle reaches a user-selected preset value.

With reference to U.S. Pat. No. 5,589,644 entitled "Torque-Angle Wrench," the instrument described herein implements a number of software features that utilize and facilitate the measurement of torque and angle, individually and simultaneously, to provide accurate fastener installation control. The present instrument may include the same methods of user operation as the wrench disclosed in the '644 patent. The application relates in particular to an improvement of the electronic torque wrench disclosed in the '644 patent, the disclosure of which is hereby incorporated herein by reference.

The present instrument is an electronic torque wrench with the addition of a gyroscopic sensor for measuring the rate of rotation of the wrench around the drive-head. A circuit board containing the sensor may be fit into a similar pre-existing wrench housing, such as, for example, that of the TECH-WRENCH™ manufactured and sold by the assignee of the present application, Snap-on Incorporated of Wisconsin.

The present instrument incorporates a number of software-based innovations to produce an easy to use and accurate wrench, capable of measuring both applied torque and applied angle simultaneously. Such innovations include:

- Bending beam deflection compensation;
- Simultaneous torque and angle measurement;
- Preset scroll stop at full-scale torque only;
- Scroll through (past) angle mode without waiting for sensor initialization;
- Angle mode torque units from last changed units;
- Ignoring angle measure in reverse direction;
- Sensor output offset monitoring;
- Alternating display of peak torque and angle values;
- Use of pre-torque direction to select allowable angle sensing direction;
- Use of integer math to yield accuracy comparable to floating-point math;
- Motion indicator at angle sensor initialization;
- Temperature drift compensation;
- Direct connection of the torque and angle sensors to the microprocessors;
- Angle zero set function;
- Signal level monitoring for over-speed indication; and
- Sample data interrupt technique used to convert instantaneous angular velocity signal to filtered angle position.

A. Instrument Housing

Figure 1A:
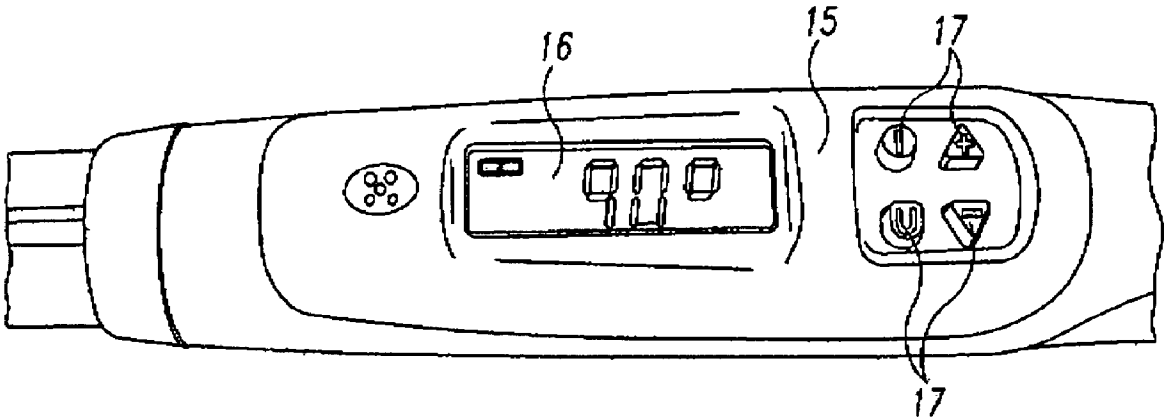
FIG. 1A is a close-up view of the user interface section of the embodiment of the present invention shown in FIG. 1.
Figure 2:
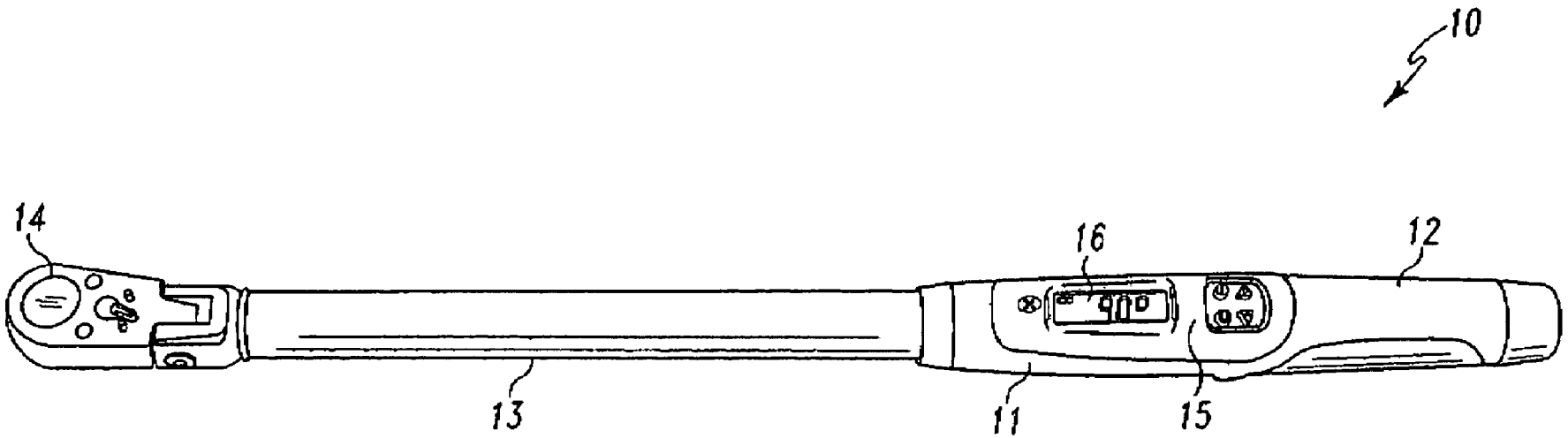
FIG. 2 is a side view illustrating another possible embodiment for the instrument of the present invention.
Figure 3A:
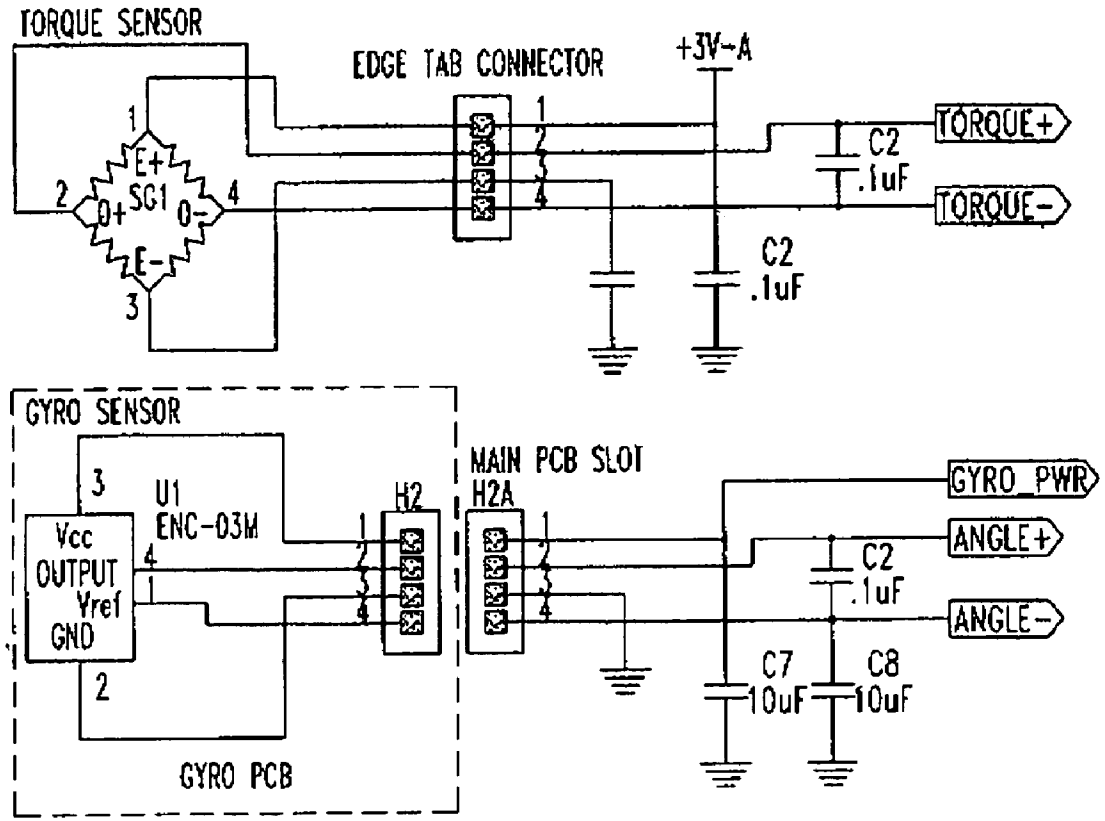
FIGS. 3A-3D are schematics illustrating an embodiment of the electronics of the present instrument.
Figure 3B:
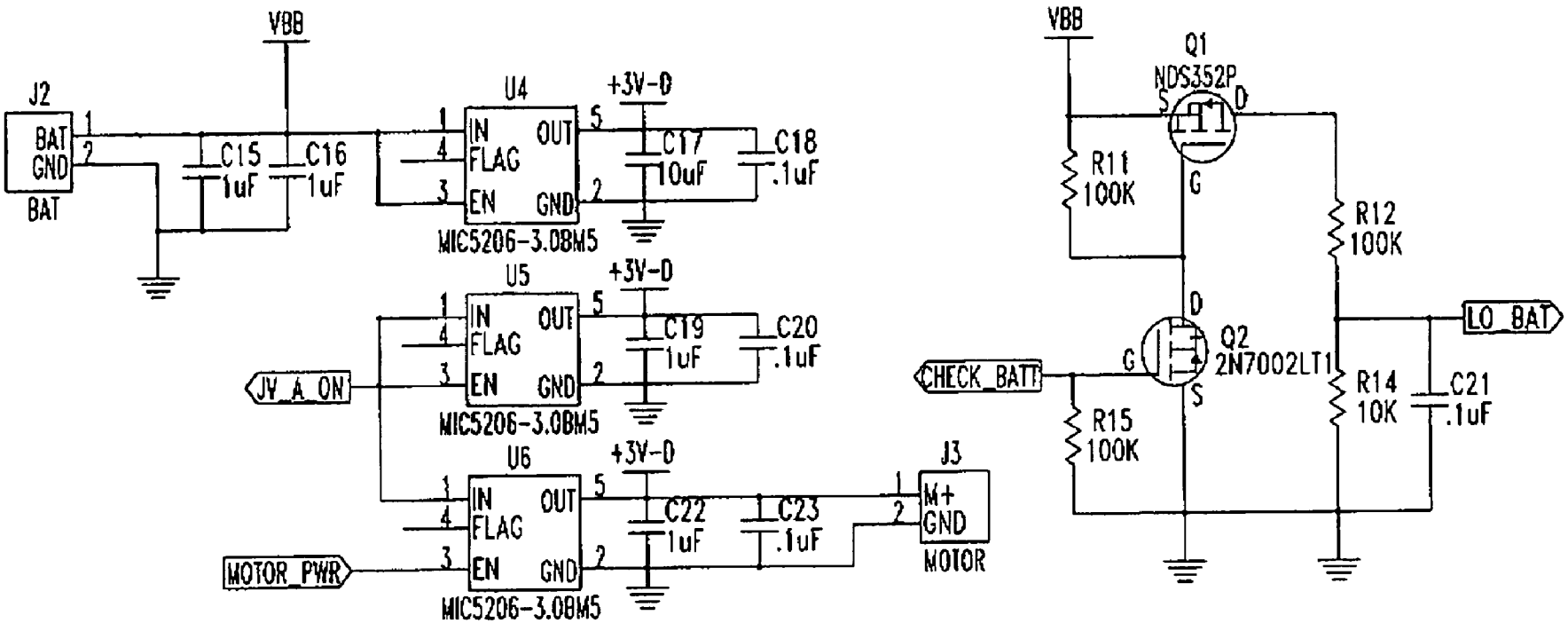
Figure 3C:
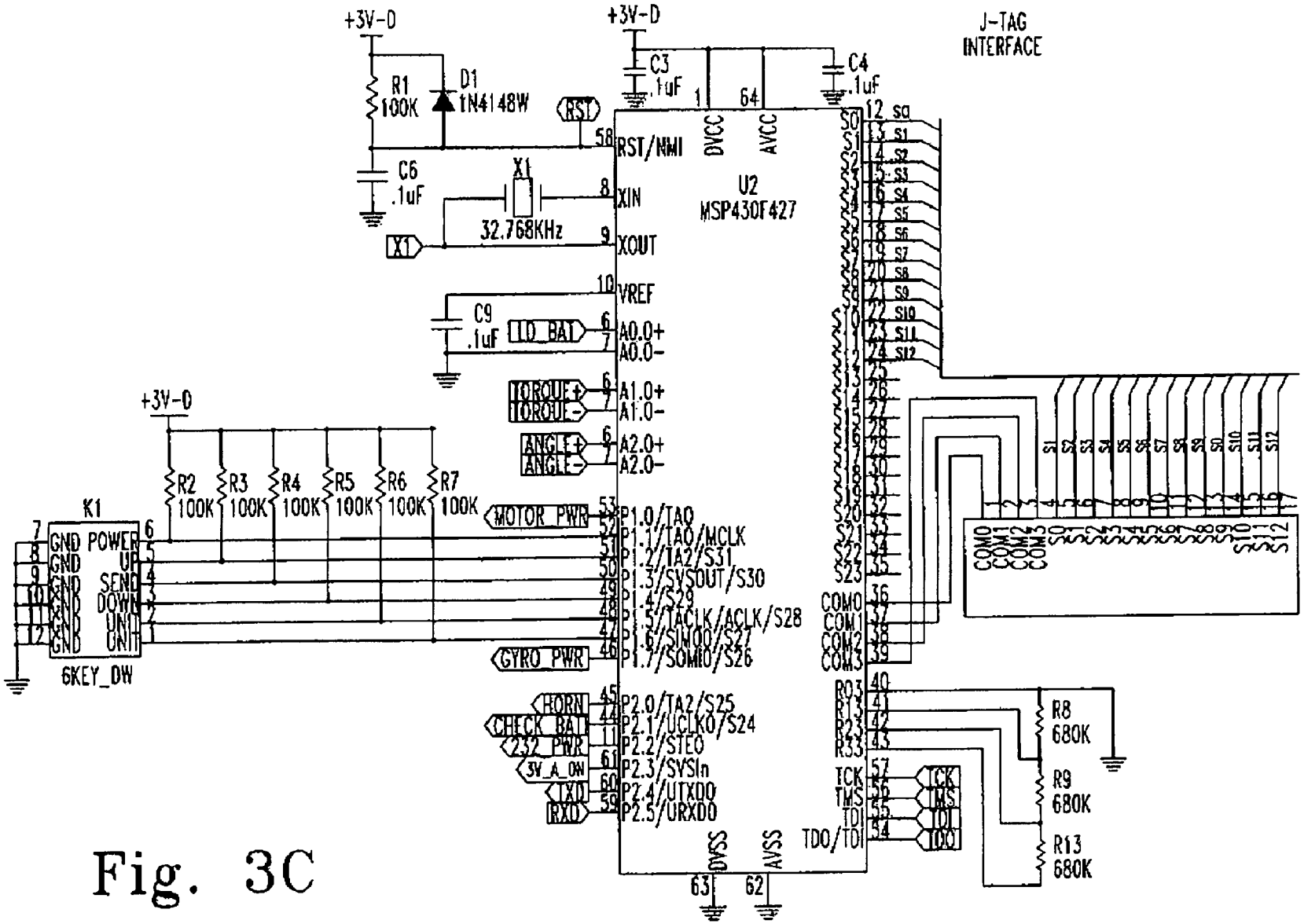
Figure 3D:
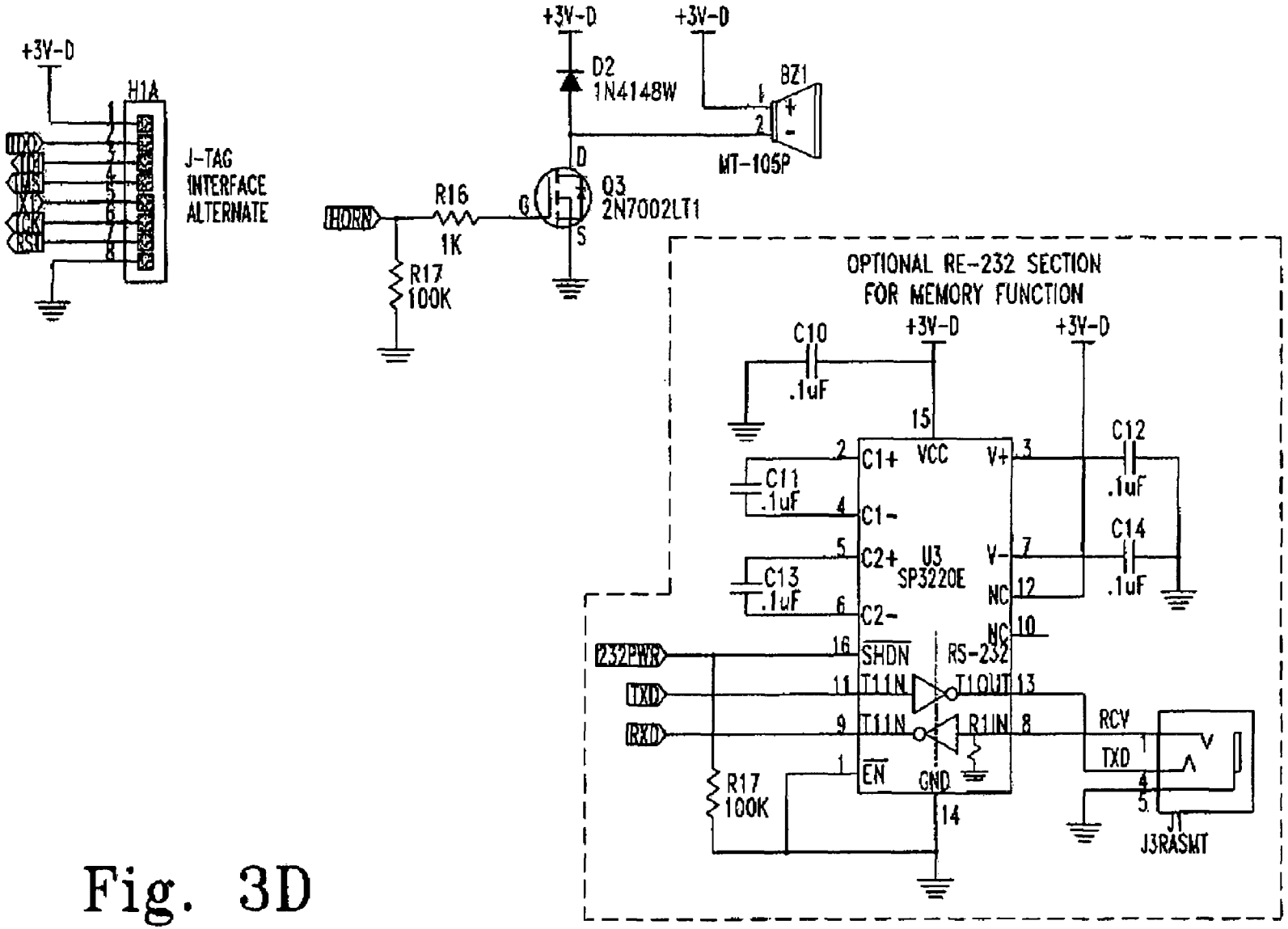

Referring to FIGS. 1, 1A and 2, a few possible embodiments of the torque-angle instrument are shown. There is illustrated an electronic torque-angle instrument, generally designated by the numeral 10. The instrument 10 is defined by an elongated housing 11, including a tubular gripping portion 12 at one end, made of steel, aluminum, or other suitable rigid material, a forward extending portion 13 containing a wrench head 14 pivotally supported at the working end of housing 11, and an electronic housing unit 15 which contains the electronics and display components to be described below. Wrench head 14 is shaped to slidably engage a socket (not shown) which is to be used to tighten the head of a bolt or a nut.

The present invention is easily adaptable to operate with most any similar wrench or instrument regardless of most operation parameters, such as torque capacity, and many physical dimensions, such as length, weight, etc. The electronic housing unit 15 is shown provided on the outside thereof with a display window 16, but may comprise instead light emitting diodes or other type of character indicating display, adapted to respond to the signals presented thereto by the underlying display circuitry to be discussed below. Also included on the instrument 10 are selection keys or buttons 17, each performing a unique function in cooperation with the electronic circuit and display components in electronic housing unit 15.

B. Circuitry

The circuitry can be split into four major functions. These are:

Microprocessor (the logic and control center, plus support hardware);

Power Supply (for the microprocessor and the sensors);

Inputs (sensors, keypad and programming port); and

Outputs (LCD, buzzer and vibrating motor).

With reference to FIGS. 3A-3D, each function of the wrench is explained in detail below.

1. Microprocessor U2:

The microprocessor circuitry receives the torque and angle (gyroscope) sensor outputs, along with the keypad and battery voltage monitor outputs. These are interpreted by the software program, yielding accurate torque and/or angular rotation information, which is sent to the LCD for display. The microprocessor also controls audio (buzzer) and tactile (vibrating motor) alerts.

The preferred microprocessor U2 is a Texas Instruments MSP430F427 Microcontroller. Capacitors C3 and C4 filter noise from the power supply traces as they connect to the DVCC and AVCC (digital and analog supply voltage) inputs, respectively. Crystal X1, operating at 32.768 kHz, provides the clock signal for U2. Capacitor C9 filters noise from U2 pin 10 (VREF), which is not used. Resistor R1 and Capacitor C6 form an RC network. When connected to U2 pin 58 (RST), they assure that when the AA batteries are replaced, U2 is not allowed to function until the supply voltage has stabilized. Diode D1 allows the voltage at pin 58 to fall immediately upon battery removal, thus protecting U2 from damage. Resistors R8, R9 and R13 establish the multiple analog voltages for the LCD display.

2. Power Supply:

The power supply provides regulated power to the microprocessors, the sensors, the buzzer and the vibrating motor.

Connector J2 connects the battery holder, containing preferably three AA batteries, to the circuit board. Capacitors C15 and C16 filter noise that may be picked up by the battery holder leads before it reaches the voltage regulators. Voltage Regulators U4-U6 are preferably Micrel MIC5235-3.0YM5 regulators with enable inputs. Capacitors C17-C20 and C21-C22 quench oscillations and noise from the regulators to which they are attached. Regulator U4 supplies power to the micro U2, and is always active, as the enable pin (U4 pin 3) is tied to the battery (+). Regulator U5 supplies power to the torque sensor SG1, and is only active when the micro is active, and sends a HI output to the enable pin (U5 pin 3), thus saving battery life when not in use. Regulator U6 supplies power to the vibrating motor through connector J3, and is only active when U2 pin 53 sends a HI output to U6 pin 3.

3. Inputs:

The inputs provide the signals that the microprocessor interprets, so that it can determine what work the wrench is imparting on the effected fastener.

Torque Sensor SG1 is a four-element full-bridge strain gage attached to a bending beam. Two elements are active (measuring tension and compression), while the other two provide temperature compensation. When voltage is supplied to point (1) on SG1 from U5 pin 5, the sensor acts as a wheatstone bridge. When no torque is applied to the bending beam, all four elements have equal resistance, therefore the voltage at points 2 and 4 are equal, at [+3V-A]/2. However, if torque is applied, the active elements change resistance (one element increases while the other decreases, depending on the direction of the torque applied), and the bridge becomes unbalanced, creating a voltage differential between points 2 and 4 on SG1. The value of the differential voltage is linearly representative of the torque being applied to the bending beam. Torque Sensor SG1 is connected to the PCB at the Edge Tab Connector. It receives power through its connection to the regulator U5 (pin 3). The differential outputs (points 2 and 4) are fed to the micro U2 pins 4 and 5. Capacitor Cl filters noise that might be picked up at SG1, while Capacitor C2 filters noise from the power supply trace.

Gyro Sensor U1 is preferably a Murata ENC-03M Piezoelectric Gyroscopic Sensor. Its output (pin 4) varies in relation to its rate of rotation in one sensitive axis, while the reference (pin 1) is static at the approximate value of the output at 0%/sec. rotation. Sensor U1 is connected to the main PCB at slot H2. Supply voltage is fed to U1 pin 3 directly from the micro (U2 pin 46), thus powering the sensor U1 only as necessary to save battery life. The output (U1 pin 4) is fed to the micro U2 pin 6, while the reference (U1 pin 1) is fed to the micro U2 pin 7. Capacitor C5 filters noise that might be picked up at U1. Capacitors C7 and C8 provide improved noise performance out of the sensor U1. The keypad serves as the user interface with the tool. It allows the user to change preset values and engineering units, store and print data, etc. The keypad consists of contact pads on the PCB, plus rubberized overlays containing either four or six conductive-backed buttons. The contact pads feed directly to the micro at pins 47-52. Resistors R2-R7 serve as pull-up resistors.

The battery monitor circuit is a switched voltage divider that is used to measure the voltage of the AA batteries. Resistors R12 and R14 served as the voltage divider. The junction of these provides a voltage that is a fraction of the battery voltage, which is within the range of the micro input (U2 pin 2). Transistor Q2 serves as an inverter, converting the active-HI output from the micro (pin 44) to an active-LO signal that is fed to Transistor Q1. Transistor Q1 connects the voltage divider to the battery, only as necessary to take battery voltage readings, thus saving battery life.

4. Outputs

The outputs provide information to the user for appropriately operating the wrench.

The Liquid Crystal Display (LCD) module L1 provides alphanumeric information regarding the operating modes, preset value, measurement results, etc. of the wrench. It is connected to the micro (U2) through conductive strips that connect to U2 pins 12-24 and 36-39.

The Vibrating motor creates a tactile alert for the user, that torque should be released on the wrench. This motor is connected to the PCB though connector J3 to the output of Regulator U6 (pins 5 and 2) and is enabled by a logic HI at U6 pin 3.

The Buzzer BZ1 provides an audio alert to the user, indicating preset coincidence or warning of over-torque conditions. Buzzer BZ1 is connected to Transistor Q3, which serves as a driver. When a square-wave signal from the micro U2 (pin 45) is fed through current limiting resister R16, it causes Q3 to switch ON and OFF, driving BZ1 at its fundamental (resonant) frequency. Resister R17 properly biases Q3, while Diode D2 quenches any voltage spikes that might be generated by BZ1 when Q3 switches open.

The J-TAG Interference H1A provides a means for reprogramming the microprocessor without removing it from the PCB. Port H1A is connected to the micro U2 at pin 9 and pins 54-58. When H1A is connected to a suitable computer through an MSP430 Flash Emulation Tool (Texas Instruments P/N MSP-FETP4301F 1.1 or similar), a new programming code can be set into the memory of micro U2.

The outputs also include an RS-232 data output to support the optional memory functions of the wrench. The circuitry for this function is not described in detail, as it is common architecture and not related to the invention.

C. Operation Flowcharts:

Referring now generally to FIGS. 4-15, the operational modes and states of the invention can be more readily understood. The software runs a variety of state machines. They are described below.

(1) The OP_MODE state machine defines how the wrench should behave. For example, if the OP MODE (i.e., operation mode) is SLEEP, the wrench should be sleeping. If the OP MODE is TORQUE_MEASURE, the wrench should be measuring torque.

(2) Each OP MODE state has its own state machine. For example, OP MODE TORQUE_MEASURE has many states. It can show and update a preset value, it can show how much torque is currently being measured, and it can display the maximum torque reading.

(3) Each state within each OP MODE state has a variety of logic operations that can define what to display, check if an error has occurred, or change hardware parameters (e.g. sound the horn or turn on the vibrating motor).

The flowcharts starting with the phrase "OP MODE" shows a high-level view of the actions required to leave a given state. For example, with reference to FIG. 10, "OP MODE: Torque Measure" shows all possible operational paths for the program to leave the "Torque Measure" operation mode. A description of each flowchart is given below.

Figure 4:
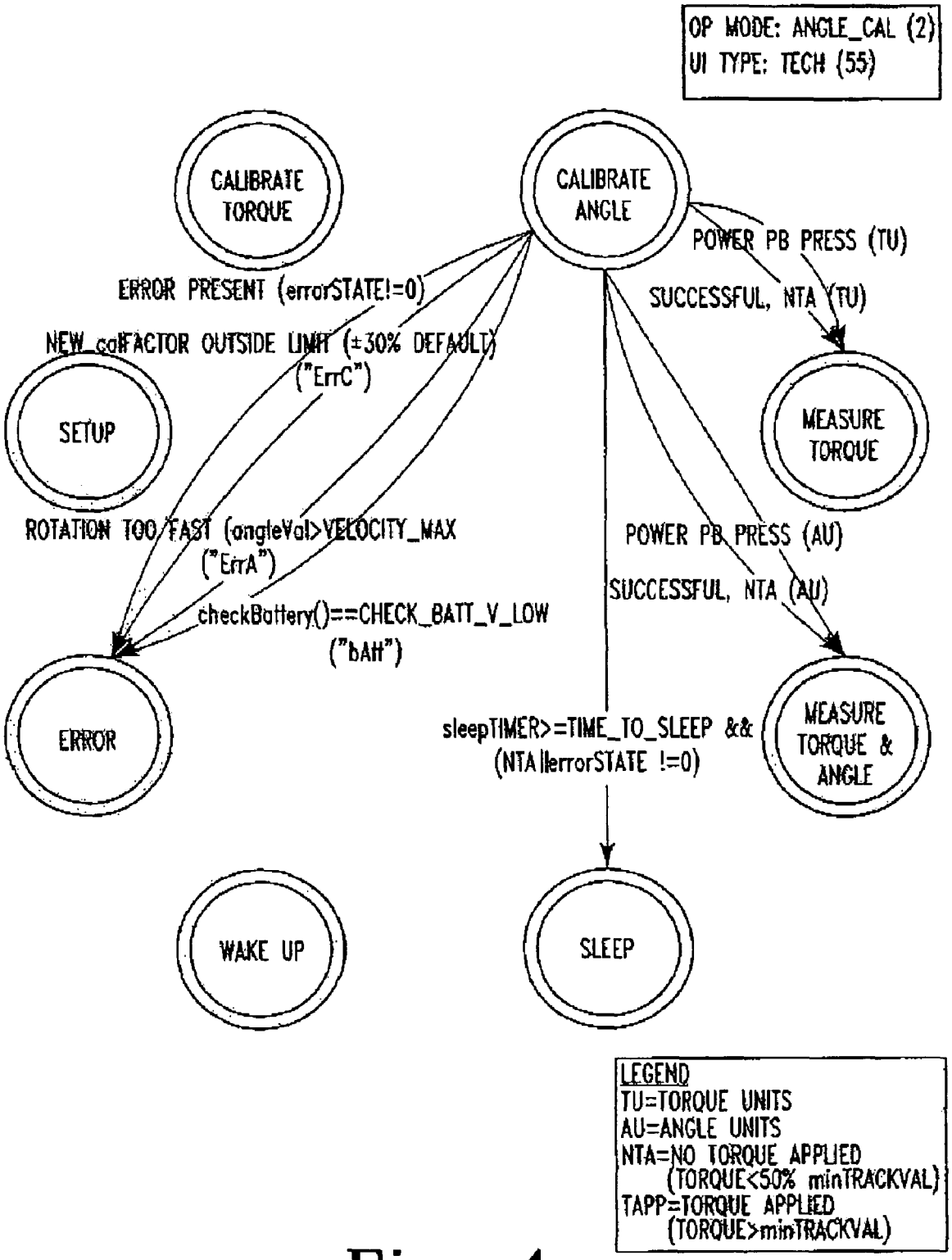
FIG. 4 is a level (1) operation flowchart, labeled "OP MODE Angle Cal," showing the available paths for the program to leave the angle calibration state.

FIG. 4 illustrates seven available paths for the program to leave the "calibrate angle" state. The user may enter the "measure torque" state (two paths), the "measure torque & angle" state (two paths), the "sleep" state (one path), and the "error" state (four paths) along the noted paths by the listed functions. For example, to enter the "measure torque" state, the two available paths include pressing the power button—path labeled "Power PB Press (TU)"—or a successful calibration—path labeled "Successful, NTA (TU)".

Figure 5:
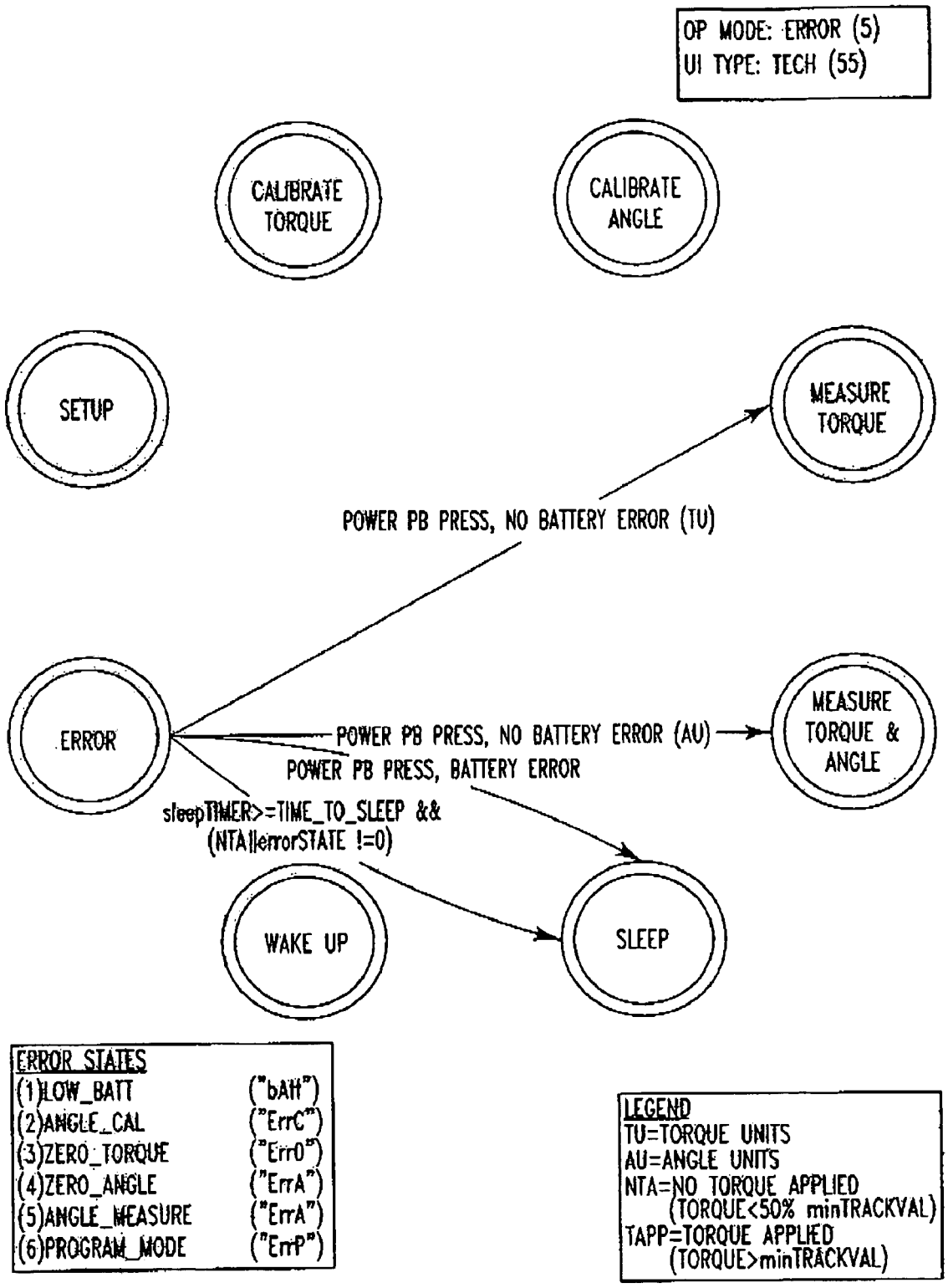
FIG. 5 is a level (1) operation flowchart, labeled "OP MODE Error," showing the paths available for the program to leave the error state.
Figure 6:
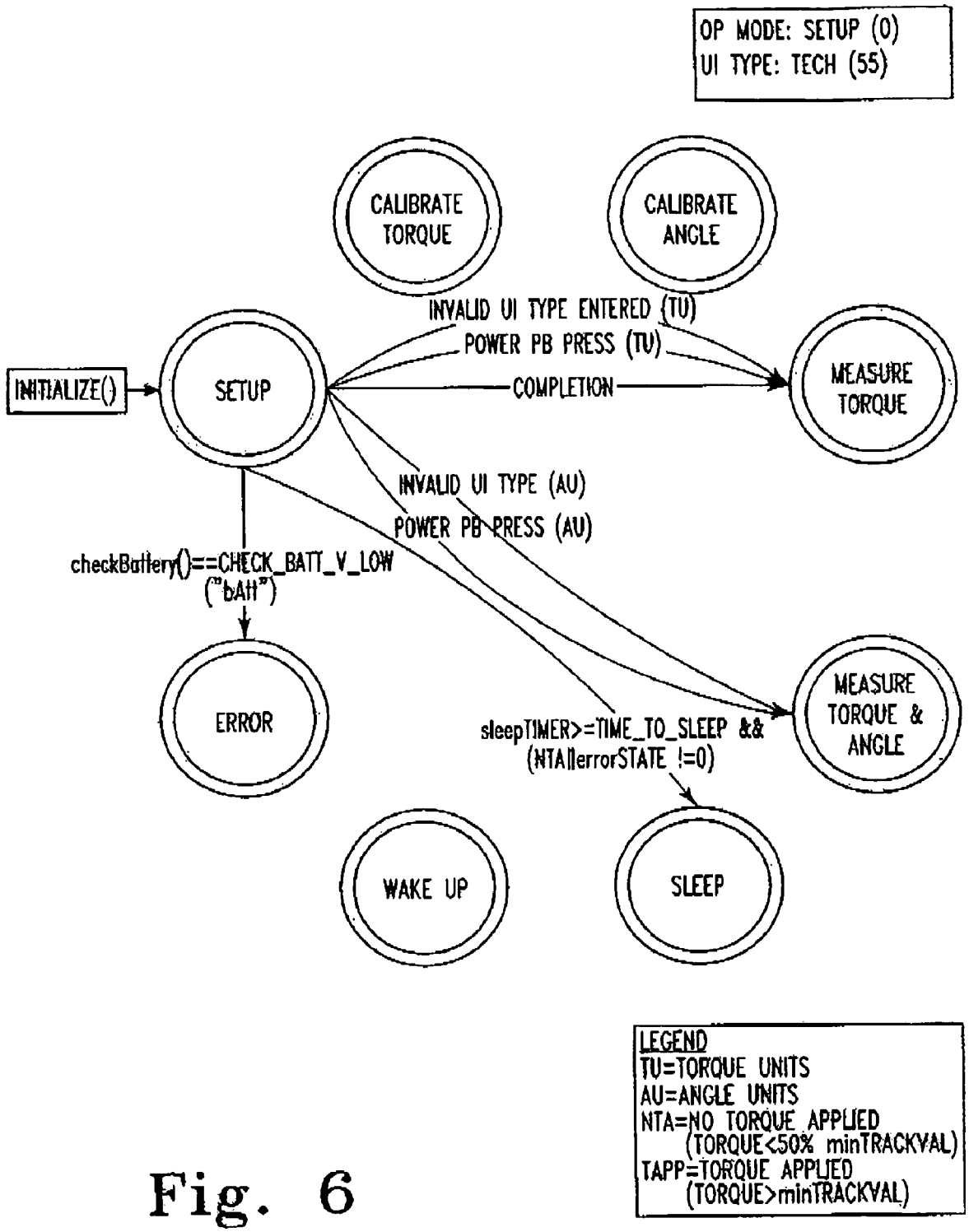
FIG. 6 is a level (1) operation flowchart, labeled "OP MODE Setup," showing the paths available for the program to leave the setup state.
Figure 7:
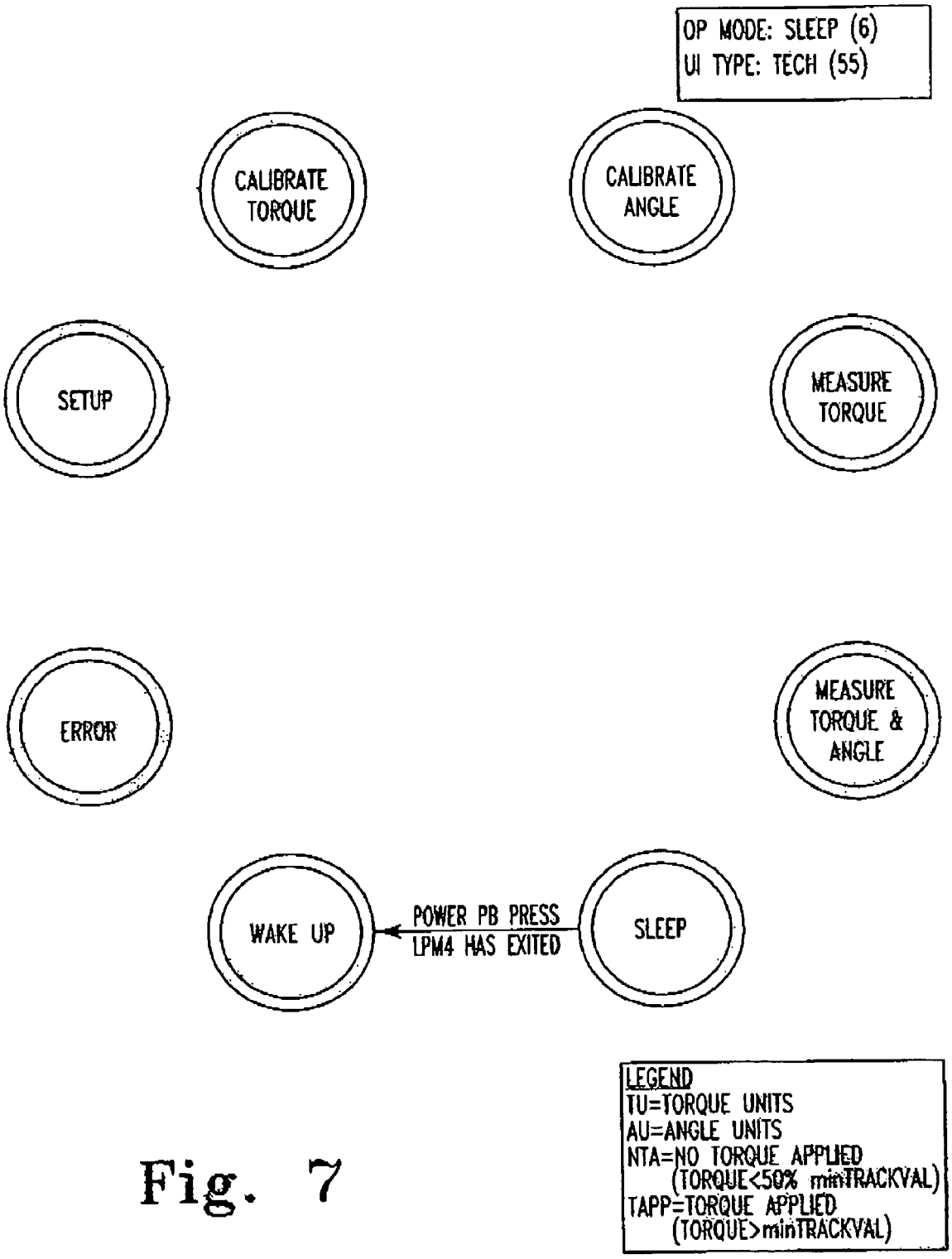
FIG. 7 is a level (1) operation flowchart, labeled "OP MODE Sleep," showing the paths available for the program to leave the sleep state.

FIG. 5 illustrates four paths available for the program to leave the "error" state. The program includes a single path to enter the "measure torque" state and the "measure torque & angle" state, and two available paths to enter the "sleep" state. FIG. 6 illustrates the seven paths available for the program to leave the "setup" state. The program may enter the "measure torque" state (three paths), the "measure torque & angle" state (two paths), and a single path to enter both the "sleep" state and the "error" state. FIG. 7 illustrates a single path available into the "wake up" state for the program to leave the "sleep" state, accomplished by pressing the power button.

Figure 8:
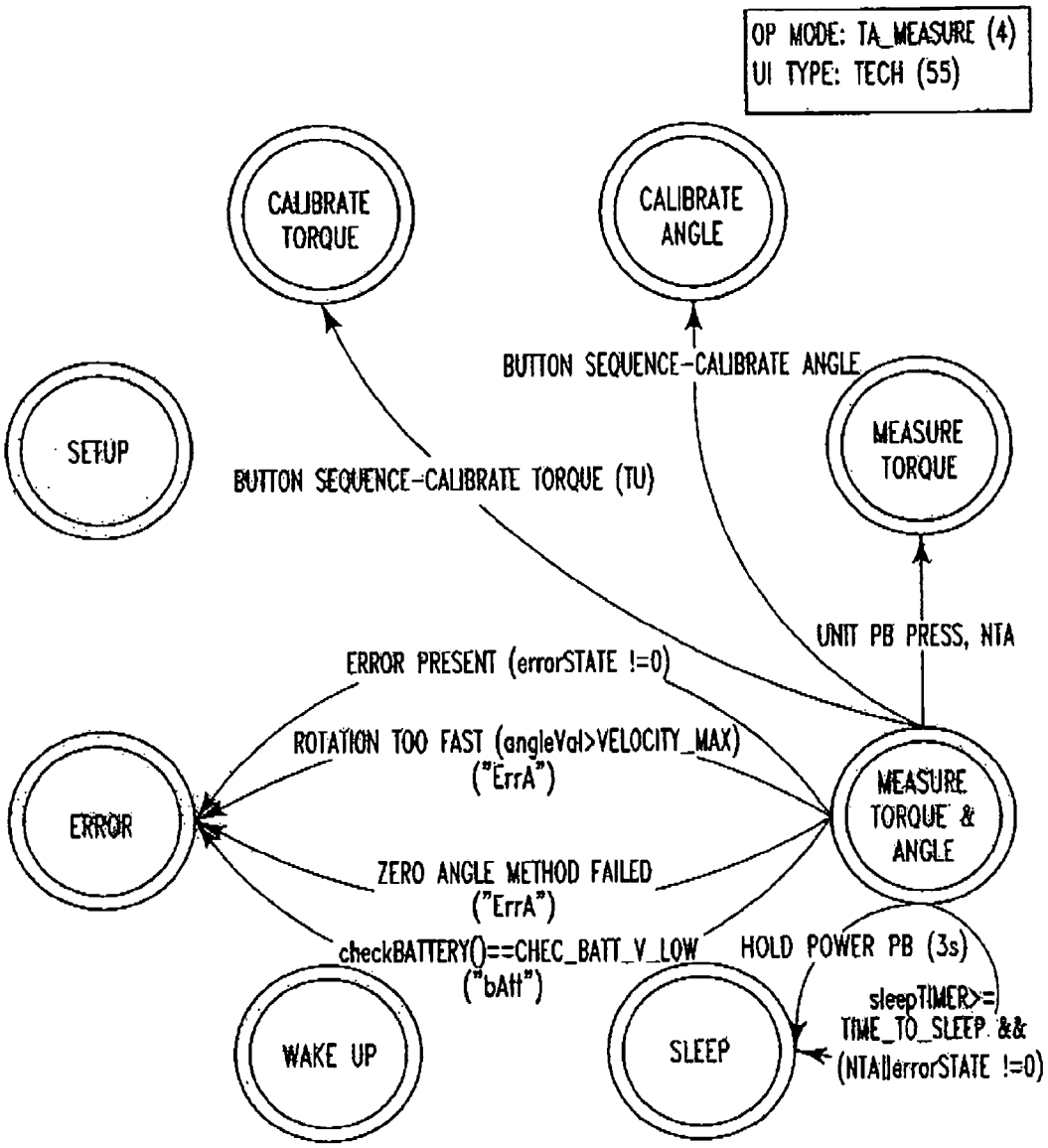
FIG. 8 is a level (1) operation flowchart, labeled "OP MODE TA Measure," showing the paths available for the program to leave the torque and angle (TA) measure state.
Figure 9:
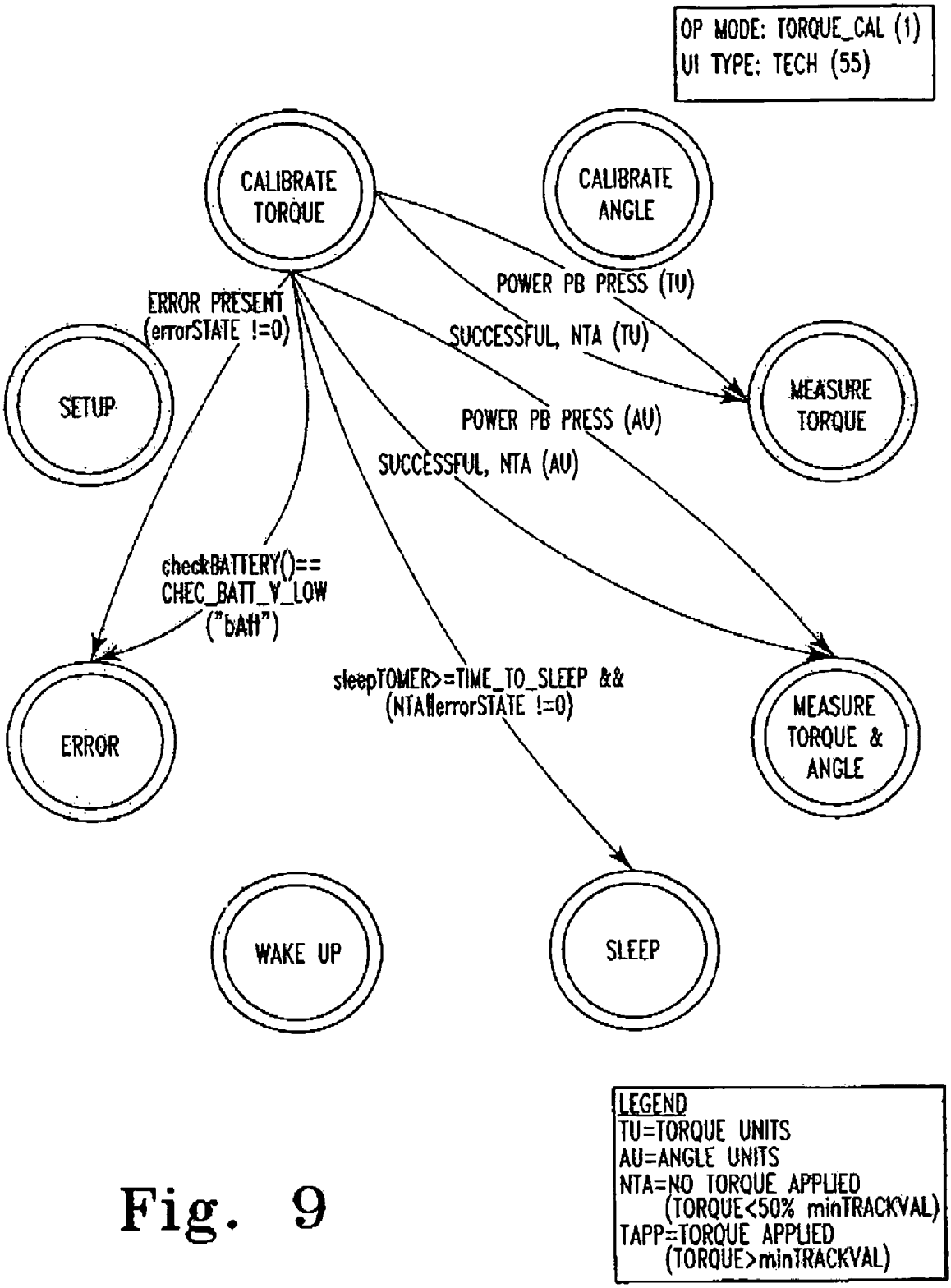
FIG. 9 is a level (1) operation flowchart, labeled "OP MODE Torque Cal," showing the paths available for the program to leave the torque calibration state.

The program may leave the "measure torque & angle" operation state along nine paths, as shown in FIG. 8. Only the "setup" state and "wake up" state are unavailable from this state. From the "calibrate torque" state, as shown in FIG. 9, seven paths are available for the program to leave, including the "measure torque" state (two paths), the "measure torque & angle" state (two paths), the "sleep" state (single path), and the "error" state (two paths). Similar to the "measure torque & angle" state of FIG. 8, the "measure torque" state may be left to all but the "setup" state and the "wake up" state along its eight available paths shown in FIG. 10.

Figure 11:
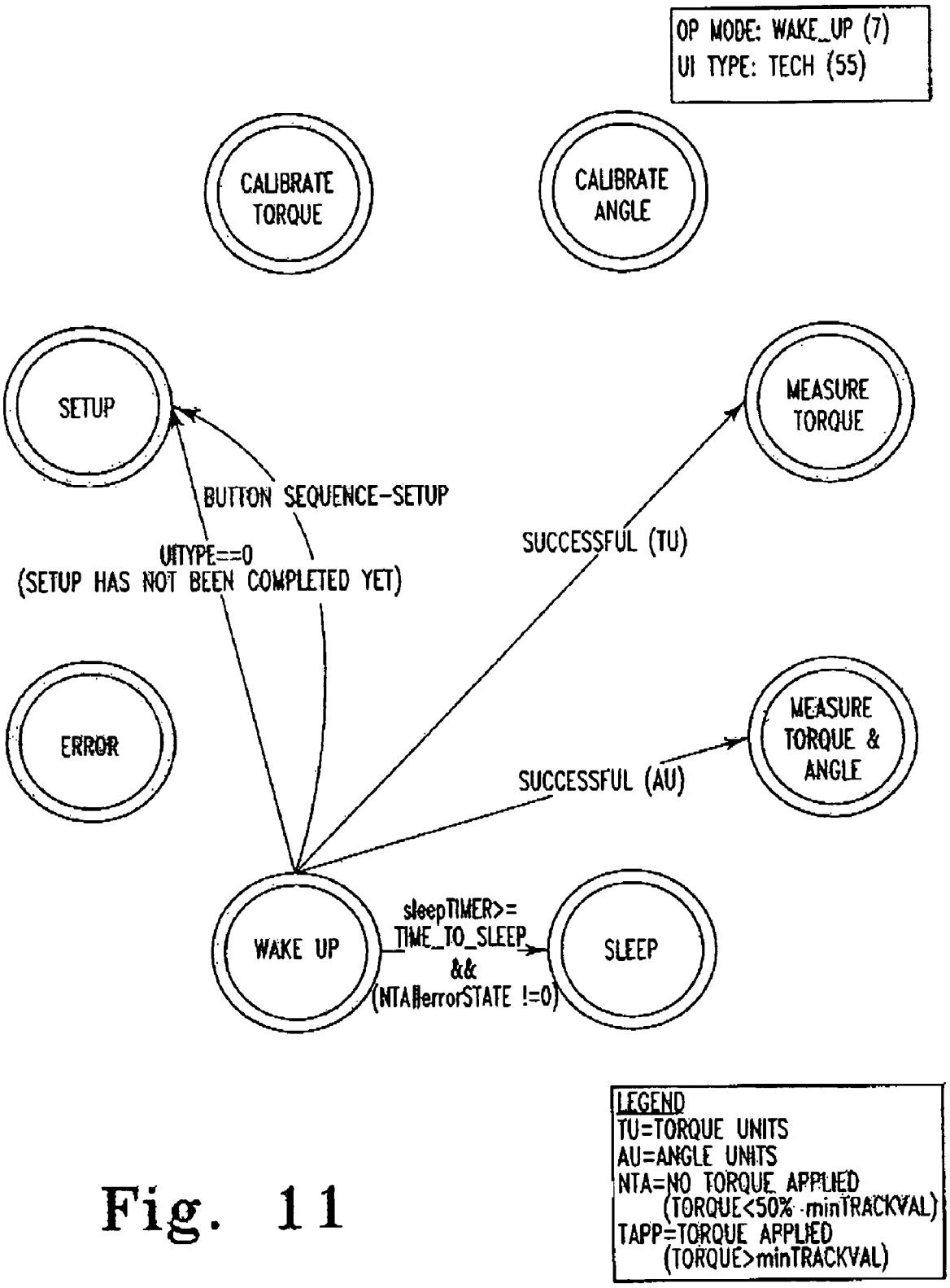
FIG. 11 is a level (1) operation flowchart, labeled "OP MODE Wake Up," showing the paths available for the program to leave the wake up state.

FIG. 11 illustrates the five paths available for the program to leave the "wake up" state. The program may enter the "setup" state (two paths), and the "measure torque" state, the "measure torque & angle" state, and the "sleep" state along a single path each.

Figure 10:
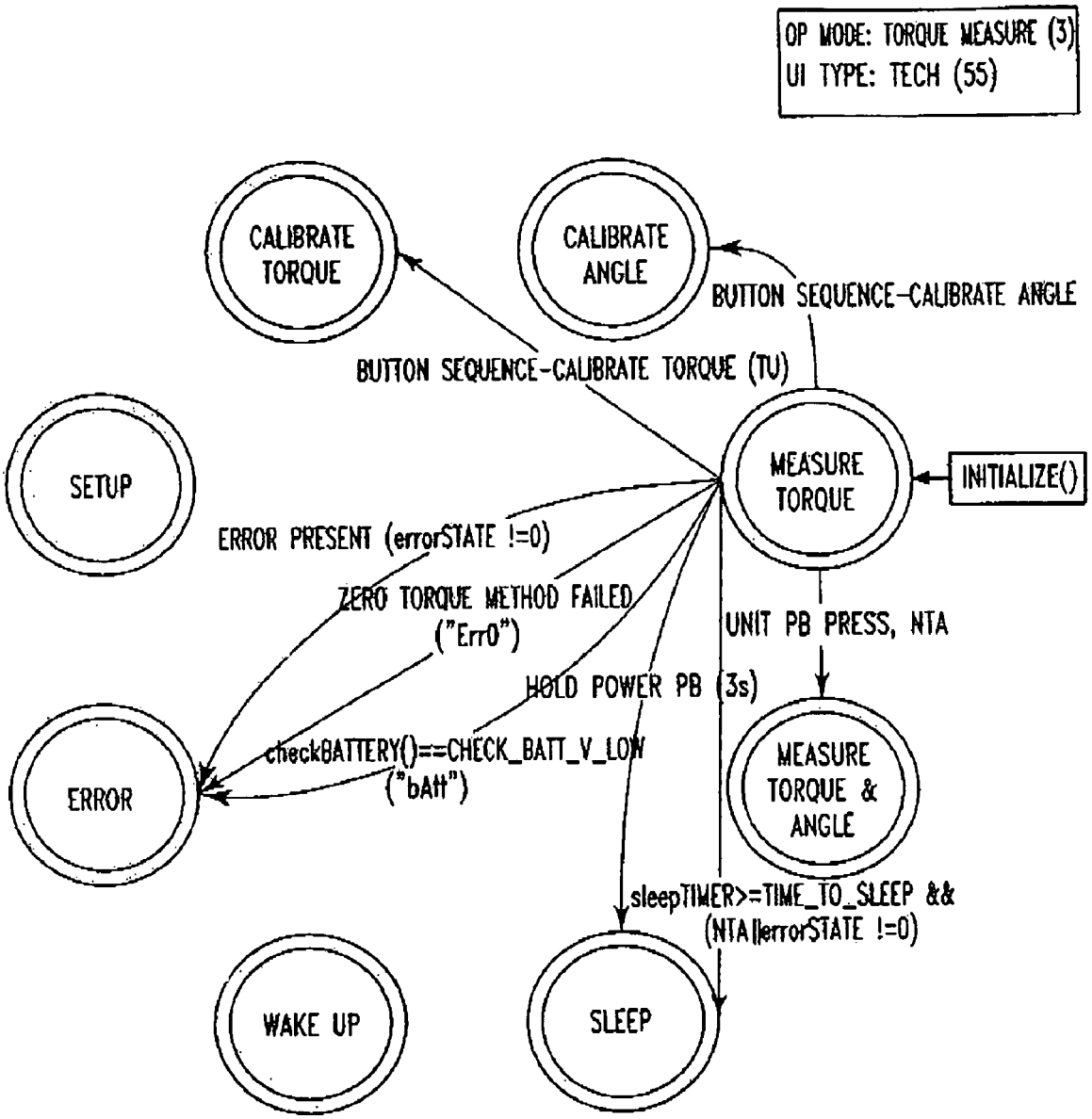
FIG. 10 is a level (1) operation flowchart, labeled "OP MODE Torque Measure," showing the paths available for the program to leave the torque measure state.
Figure 12A:
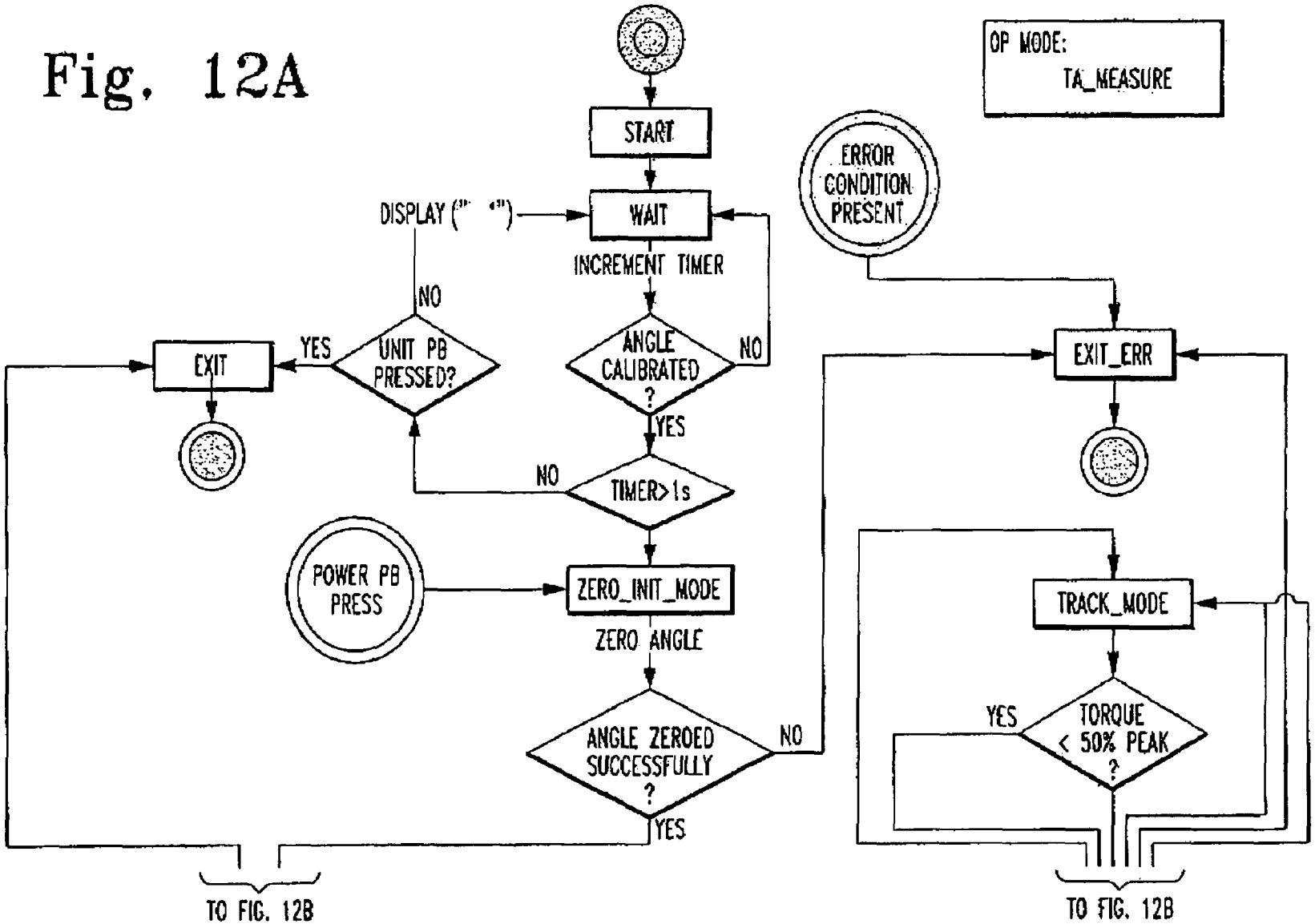
FIGS. 12A-12B are sections of a level (2) operation flowchart showing the different states within the Torque and Angle Measure Mode.
Figure 12B:
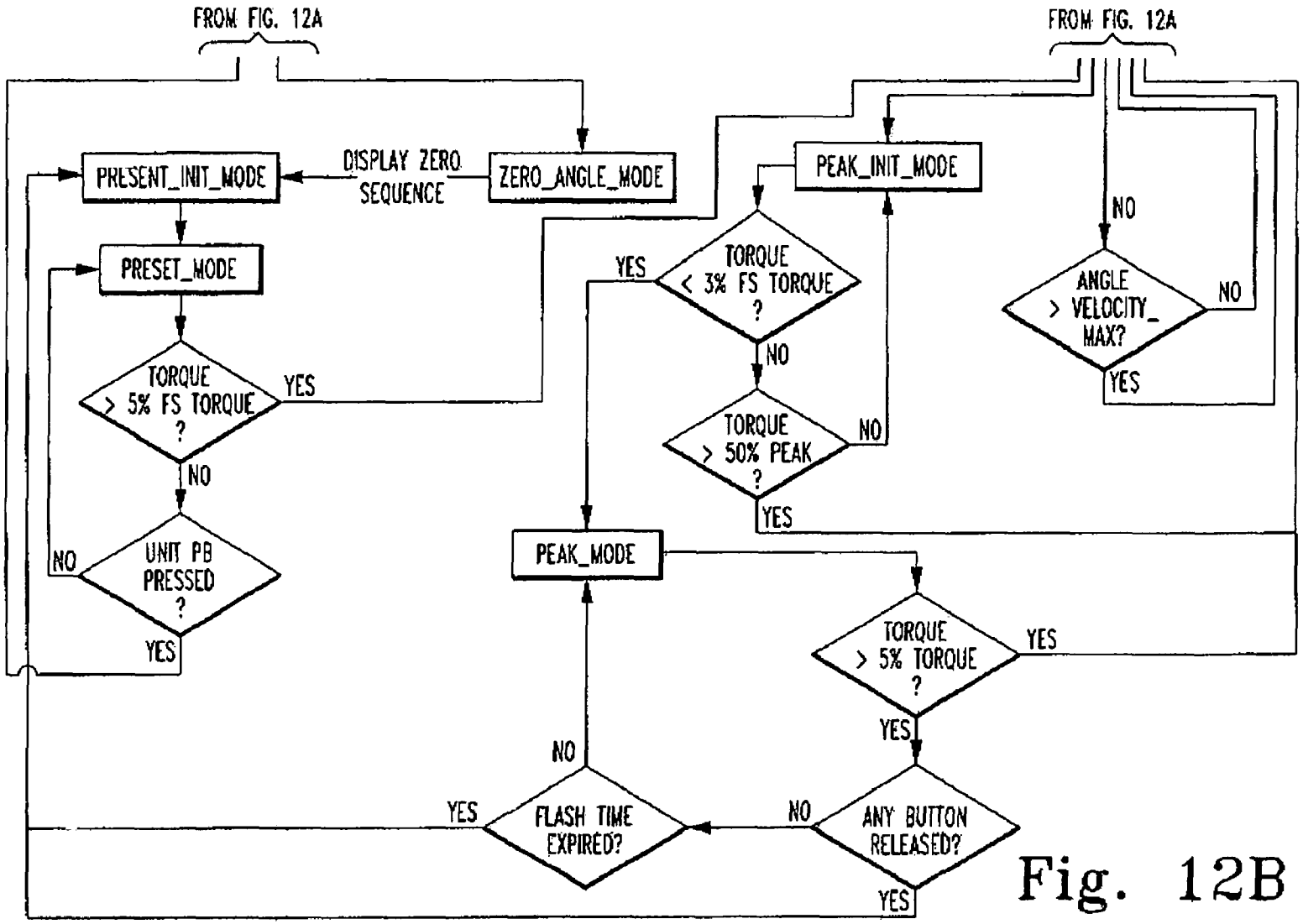
Figure 13A:
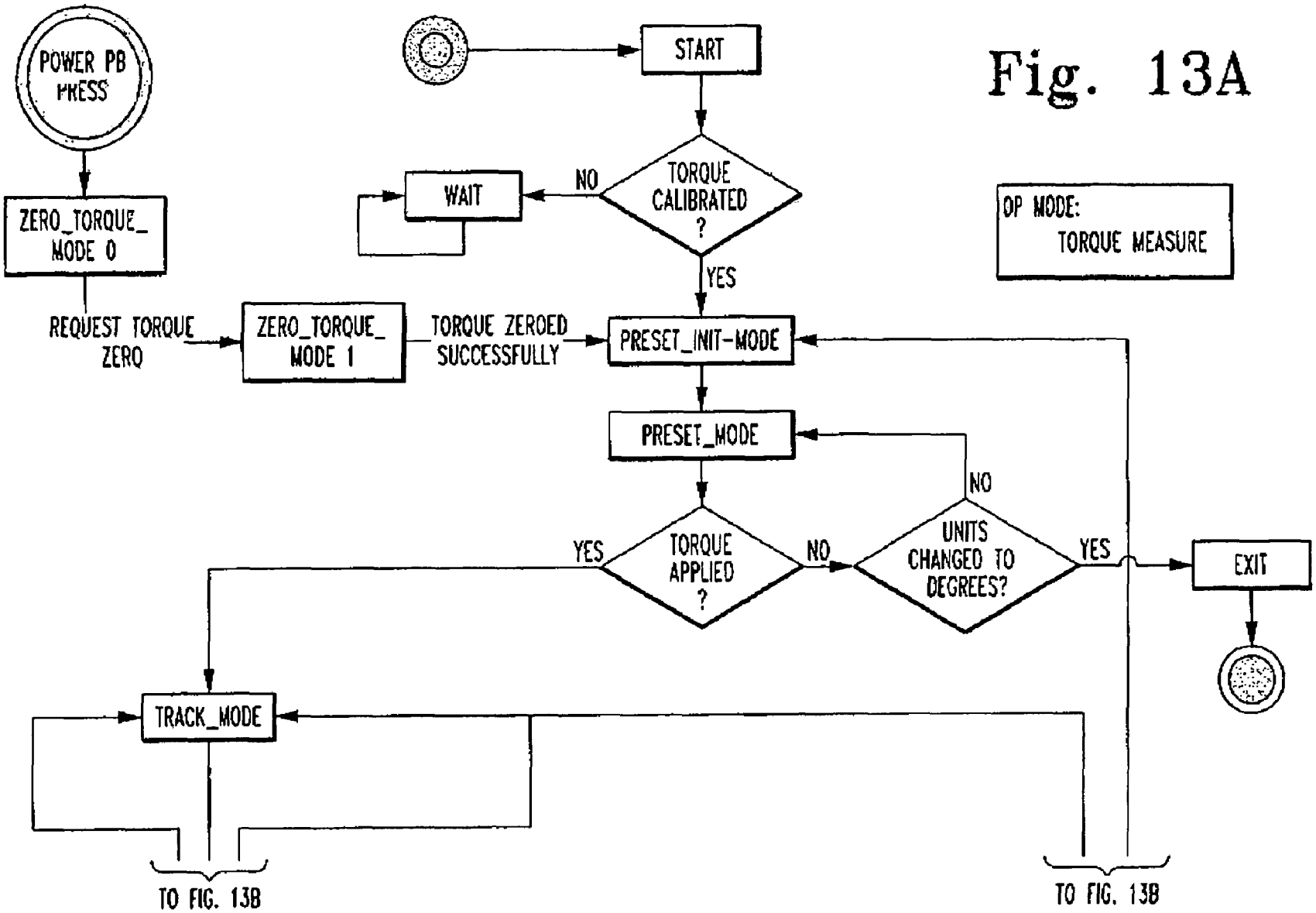
FIGS. 13A-13B are sections of a level (2) operation flowchart showing the different states within the Torque Measure Mode.
Figure 13B:
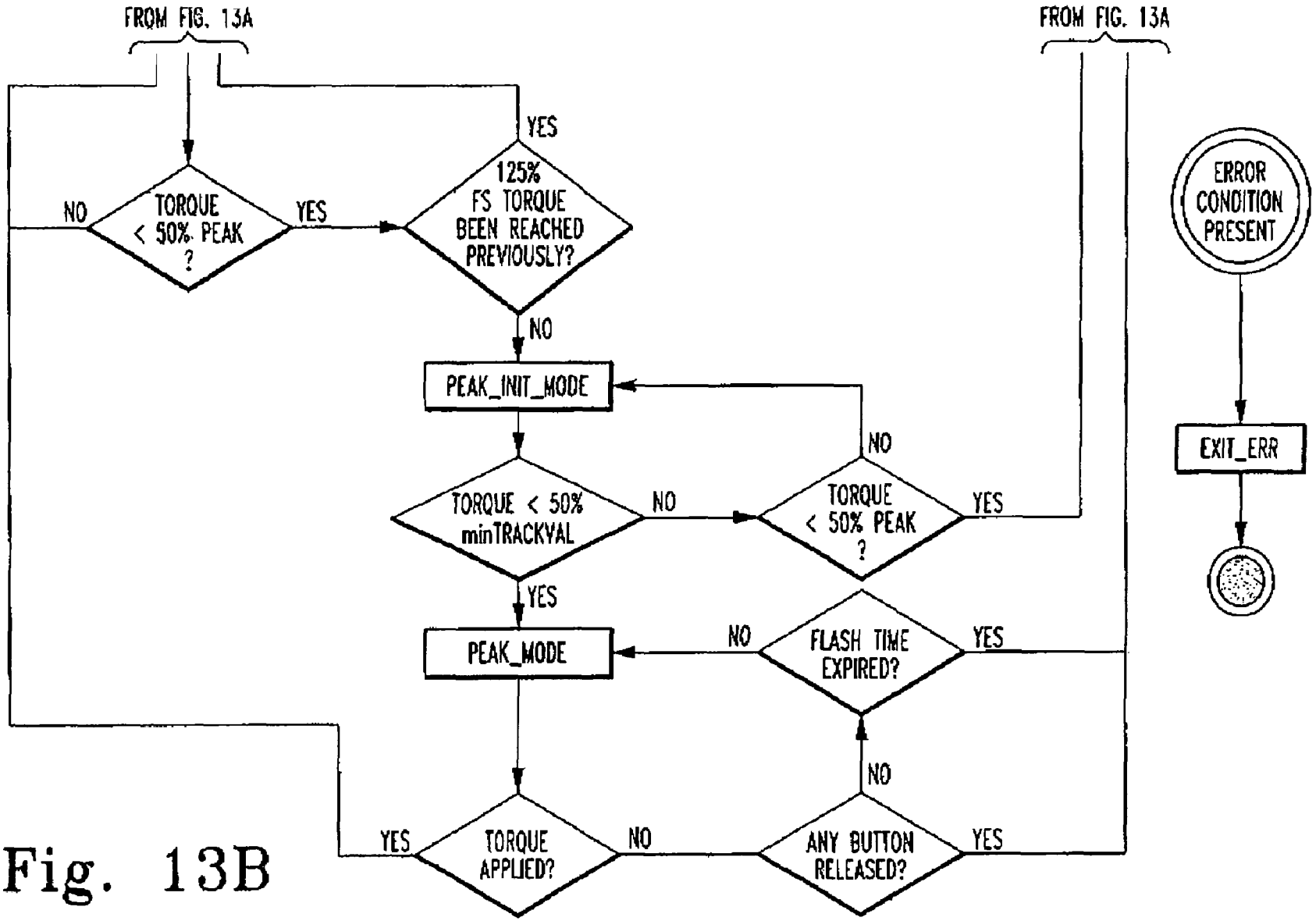

Regarding the Level (2) Flowcharts, FIGS. 12A and 12B illustrate the steps of operation through the different modes (e.g., Zero_Init_Mode, Zero_Angle_Mode, Track_Mode, Preset_Init_Mode, etc.) within the "Measure Torque & Angle" state of FIG. 8, while FIGS. 13A and 13B illustrate operational steps through the different modes (e.g., Zero_Torque_Mode, Preset_Init_Mode, Track_Mode, Peak_Init_Mode, etc.) within the "Measure Torque" state of FIG. 10.

Figure 14A:
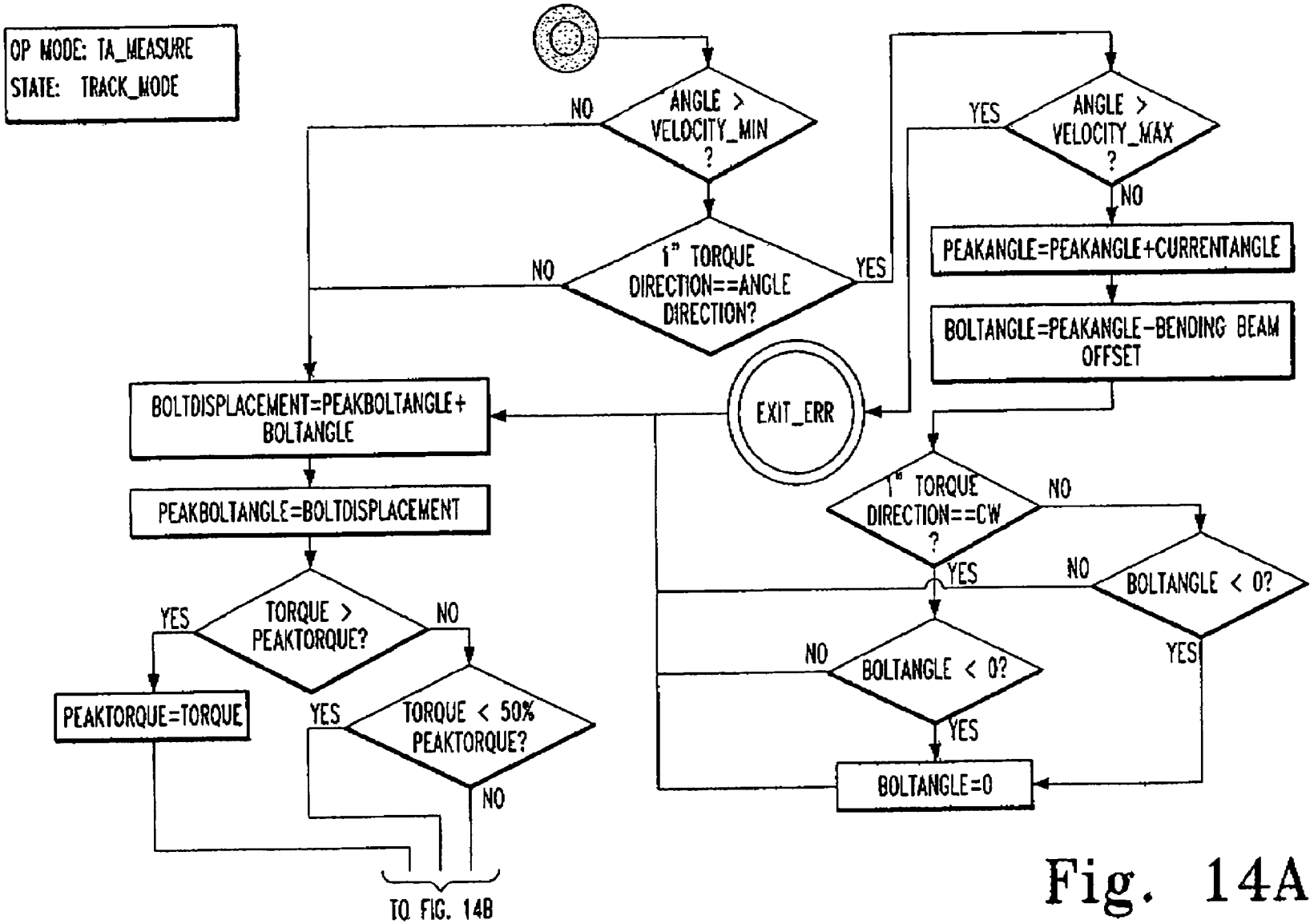
FIGS. 14A-14B are sections of a level (3) operation flowchart showing the logic within the TRACK state of the Torque and Angle Measure Mode of FIGS. 12A and 12B.
Figure 14B:
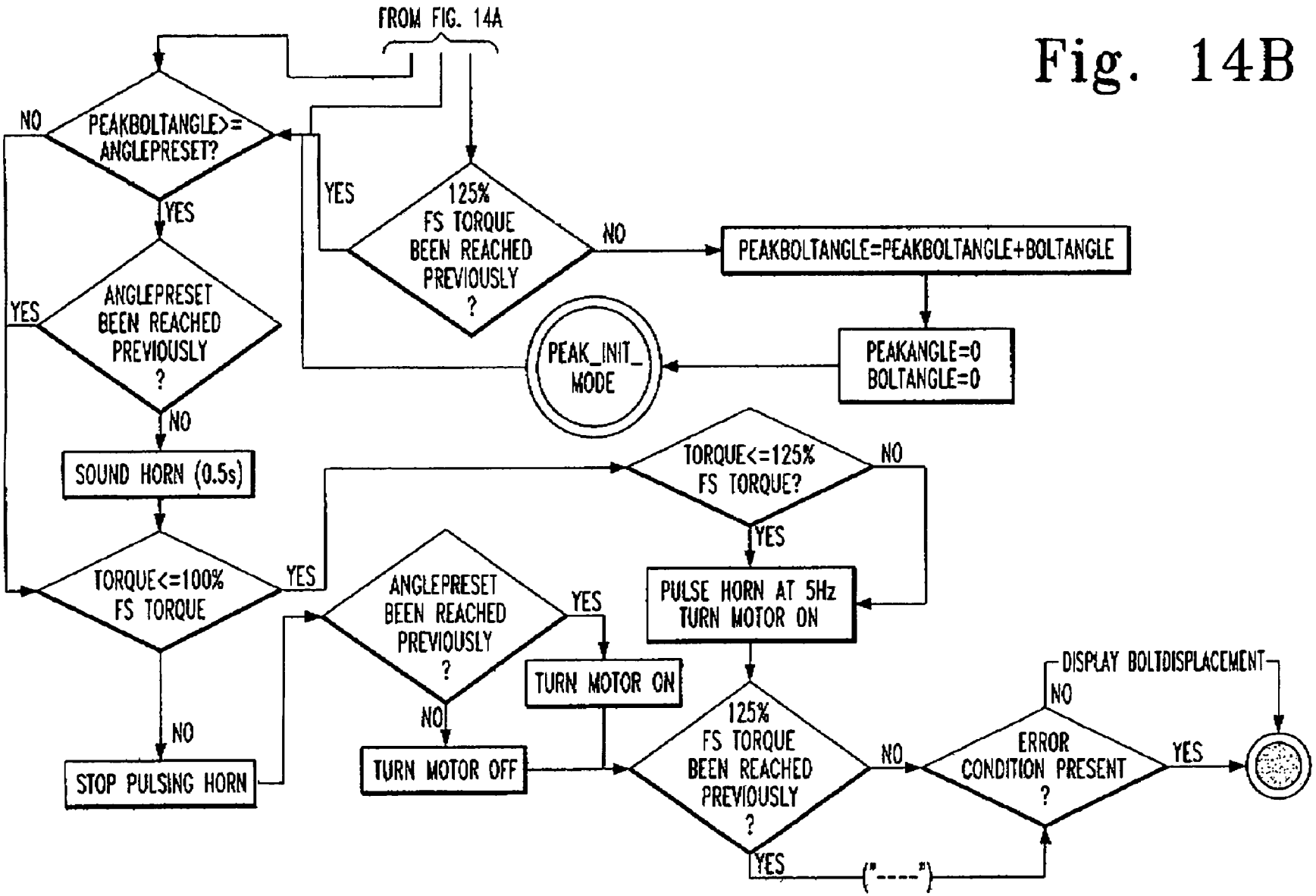
Figure 15A:
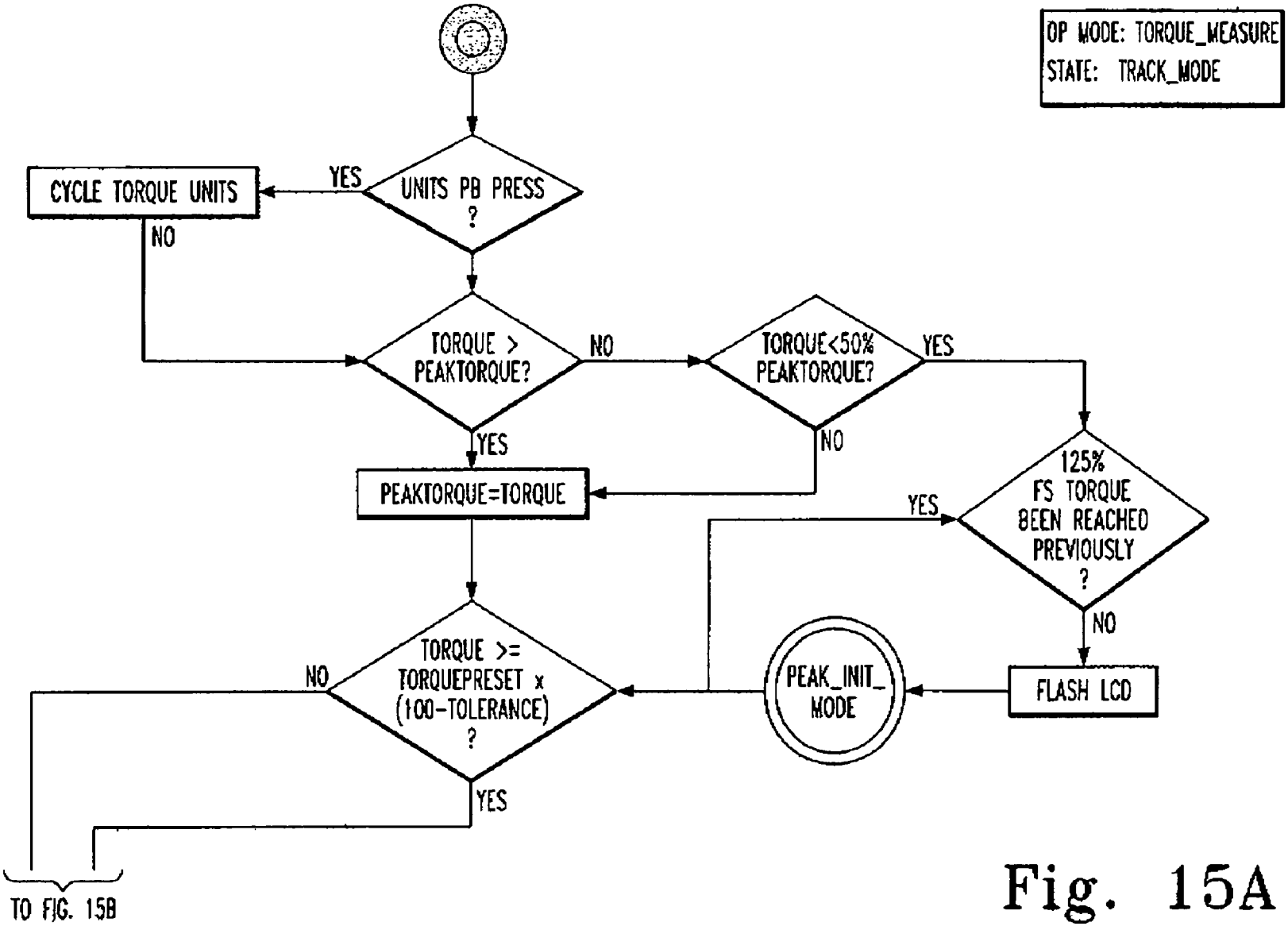
FIGS. 15A-15B are sections of a level (3) operation flowchart showing the logic within the TRACK state of the Torque Measure Mode of FIGS. 13A and 13B.
Figure 15B:
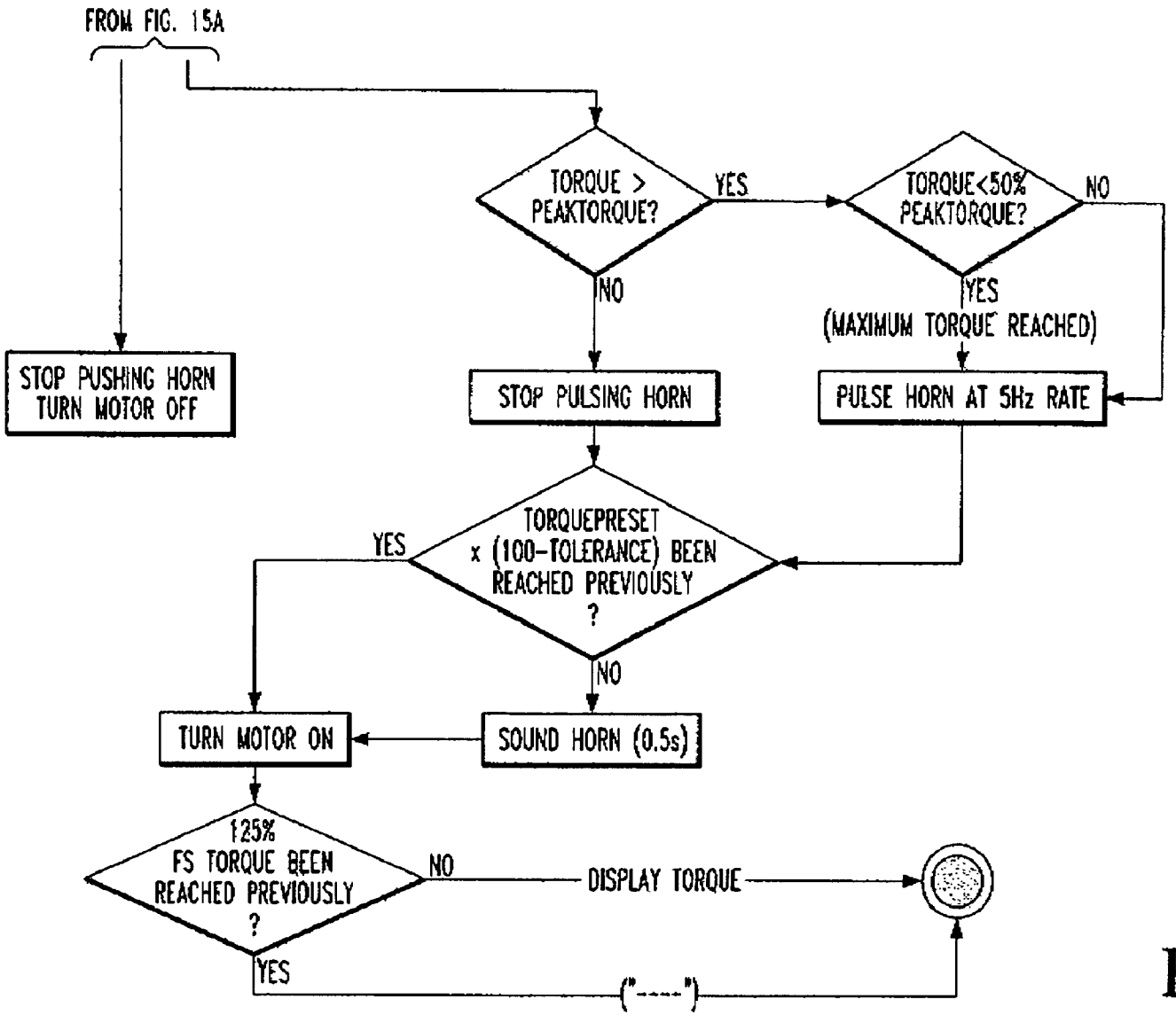

As for the Level (3) Flowcharts, FIGS. 14A and 14B illustrate the logic steps of the software within the "TRACK" state of the "Measure Torque & Angle" mode shown in FIGS. 12A and 12B. FIGS. 15A and 15B show the logic steps of the software within the "TRACK" state of the "Torque Measure" mode of FIGS. 13A and 13B. Those skilled in the art would be able to prepare the necessary software programming from these many flowcharts without additional experimentation.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A method for measuring applied torque and applied angle to a workpiece either individually or simultaneously comprising the steps of:

providing a wrench having a gripping section, a drive head, and internal circuitry coupled to the drive head, wherein the circuitry comprises a microprocessor having stored programming, input means, output means, and a power supply for powering the microprocessor, the input means and the output means, wherein the stored programming comprises wrench operation modes including at least torque calibration, angle calibration, torque measure, and torque and angle measure;

selecting one of operations modes through operation of the input means;

engaging the drive head of the wrench to a workpiece;

applying torque to the workpiece around the drive head;

operating the input means to create a first signal related to both instantaneous torque and angle values being applied to the workpiece during the step of applying torque to the workpiece around the drive head;

receiving the first signal into the microprocessor from the input means;

interpreting the first signal by the stored programming, including continuously calculating a bending beam correction factor by processing the first signal to determine a corrected angle value;

sending the interpreted signal to the output means;

displaying the interpreted signal, wherein the signal is displayed as both an accurate torque measure and an angle measure from the output means.

2. The method of claim 1, wherein the circuitry input means comprises a gyroscopic sensor for measuring the rate of rotation around the drive head.

3. The method of claim 1, wherein the step of displaying the interpreted signal comprises the step of simultaneously displaying an accurate torque measure and angle measure.

4. The method of claim 1, wherein the step of displaying the interpreted signal comprises the step of alternating between display of the torque measure and the angle measure.

5. The method of claim 1, further comprising the step of controlling an alert signal by the microprocessor.

6. The method of claim 5, wherein the alert signal indicates coincidence with a preset condition.

7. The method of claim 5, wherein the alert signal indicates an over-torque condition.

8. An electronic torque-angle instrument comprising:

a generally tubular body including a gripping section and a pivoting head for engaging a workpiece, such as a nut or bolt; and a housing associated with the body and containing electronics, including input means electronically coupled to a microprocessor for sending input signals, which permit individual and simultaneous measurement and display of both torque and angle applied to the workpiece and wherein the microprocessor comprises stored programs comprising wrench operation modes including at least torque calibration, angle calibration, torque measure, and torque and angle measure, each of which interprets the input signals from the input means to continuously calculate a bending beam correction factor by processing the input signals to determine a corrected angle value, thereby accurately determining both torque and angle applied to the workpiece.

9. The electronic torque-angle instrument of claim 8, wherein the input means comprises a gyroscopic sensor.

10. The electronic torque-angle instrument of claim 8, further comprising display means for displaying the interpreted input signal.

11. The electronic torque-angle instrument of claim 8, further comprising display means for simultaneously displaying an accurate torque measure and angle measure.

12. The electronic torque-angle instrument of claim 8, wherein the display means is capable of alternating between display of the torque measure and the angle measure.

13. The electronic torque-angle instrument of claim 8, wherein the microprocessor comprises a control means for activating an alert signal.

14. The electronic torque-angle instrument of claim 13, wherein the alert signal indicates coincidence with a preset condition.

15. The electronic torque-angle instrument of claim 13, wherein the alert signal indicates an over-torque condition.

* * * * *